United States Patent [19]

Lacruche et al.

[11] Patent Number: 4,915,094

[45] Date of Patent: Apr. 10, 1990

[54] APPARATUS FOR GENERATING HIGH FREQUENCY SHOCK WAVES OF WHICH THE ELECTRICAL SUPPLY CONNECTION IS DISPOSED INSIDE A TUBULAR ELEMENT, LIMITING OR PREVENTING ELECTRO-MAGNETIC LEAKAGES

[75] Inventors: Bernard Lacruche, Chelles; Gérard Hascoet, Paris; Dominique Cathignol, Genas; Jean-Louis Mestas, Chassieu, all of France

[73] Assignees: Technomed International, Paris; Inserm, Lyons, both of France

[21] Appl. No.: 273,611

[22] Filed: Nov. 17, 1988

Related U.S. Application Data

[63] Continuation of Ser. No. 919,225, Oct. 15, 1986, abandoned.

[30] Foreign Application Priority Data

Jun. 30, 1986 [FR] France ..... 86 09474

[51] Int. Cl.[4] ..... A61B 17/22

[52] U.S. Cl. ..... 128/24 A

[58] Field of Search ..... 361/232; 128/24 A, 328

[56] References Cited

U.S. PATENT DOCUMENTS

| | | | |
|---|---|---|---|
| 2,283,285 | 5/1942 | Pohlman . | |
| 2,559,227 | 7/1951 | Rieber . | |
| 3,785,382 | 1/1974 | Schmidt et al. . | |
| 3,942,531 | 3/1976 | Hoff . | |
| 4,311,147 | 1/1982 | Hausler . | |
| 4,530,358 | 7/1985 | Forssmann et al. . | |
| 4,535,771 | 8/1985 | Takayama . | |
| 4,539,989 | 9/1985 | Forssmann et al. . | |
| 4,570,634 | 2/1986 | Wess . | |
| 4,597,388 | 7/1986 | Koziol et al. . | |
| 4,608,983 | 9/1986 | Muller et al. . | |
| 4,610,249 | 9/1986 | Makofski . | |
| 4,620,545 | 11/1986 | Shene et al. . | |
| 4,622,969 | 11/1986 | Forssmann et al. . | |
| 4,630,607 | 12/1986 | Duinker et al. . | |
| 4,702,248 | 10/1987 | Mestas et al. | 128/328 |

FOREIGN PATENT DOCUMENTS

| | | | |
|---|---|---|---|
| 2635635 | 2/1978 | Fed. Rep. of Germany | 128/328 |

*Primary Examiner*—Ruth S. Smith

*Attorney, Agent, or Firm*—Schechter, Brucker & Pavane

[57] ABSTRACT

This invention relates to an apparatus for generating high frequency shock waves, which comprises a generator of shock waves by electric discharge between at least two electrodes disposed at least in part in a chamber filled with liquid, and advantageously supplied intermittently with electric current from a source of electric current via a supply connection, the generator device allowing the focusing of the shock waves on a target, and is characterized in that the supply connection for supplying electric current to the electrodes is disposed inside a substantially closed tubular element in order to limit or prevent electro-magnetic leakages. This tubular element is preferably mounted to move in any point in space relatively to the frame and supports the shock wave generating device. Thanks to this apparatus, electro-magnetic leakages are limited or prevented and patients' safety is therefore improved.

22 Claims, 5 Drawing Sheets

APPARATUS FOR GENERATING HIGH FREQUENCY SHOCK WAVES OF WHICH THE ELECTRICAL SUPPLY CONNECTION IS DISPOSED INSIDE A TUBULAR ELEMENT, LIMITING OR PREVENTING ELECTRO-MAGNETIC LEAKAGES

This is a continuation of U.S. application Ser. No. 919,225, filed Oct. 15, 1986, now abandoned.

The present invention essentially relates to an apparatus for generating high frequency shock waves in a liquid for the remote destruction of targets such as concretions, of which the electrical supply connection is disposed inside a tubular element limiting or preventing electromagnetic leakages.

U.S. Pat. No. 2,559,227 to RIEBER discloses an apparatus for generating high frequency shock waves in a liquid for the remote destruction of targets. This apparatus comprises a shock wave generator device formed by a truncated ellipsoidal reflector comprising a cavity constituting a chamber for reflecting the shock waves, of the same truncated ellipsoidal form. One of the two focal points of the ellipsoid lies in the chamber opposite the truncated part, this chamber being filled with a liquid for transmitting the shock waves, for example an oil.

A shock wave generator device proper conventionally comprises two electrodes disposed at least in part inside the chamber, said two electrodes being arranged to generate an electrical discharge or arc at the focal point lying in the chamber opposite the truncated part.

Means are also provided for selectivity and instantaneously delivering an electric voltage to the two electrodes, thus provoking the electric discharge or arc between the electrodes, thus generating shock waves in said liquid contained in the chamber (cf. FIG. 3 and col. 7, line 51 to col. 9, line 30).

In the RIEBER document, a source of electric energy is provided, particularly a battery, selectively supplying a transformer and a condenser (cf. col. 5, line 64 to col. 6, line 26). This condenser may be charged up to a voltage of 15,000 V to generate the electric discharge or arc between the electrodes in selective manner at determined intervals (col. 9, lines 7 to 9 and 24 to 27).

The range of voltage applied and the size of the condenser depend on the nature of the use sought (col. 9, lines 27 to 29).

This apparatus is used in the medical field, particularly for the destruction of tissues (cf. col. 3, lines 30 to 64). This apparatus may also be used for exploring or stimulating various parts of the nervous system (col. 3, lines 65 to 74).

This apparatus may also be used for extracorporal lithotripsy.

French Patent No. 2 247 195 also describes a similar apparatus in which the liquid is constituted by water (page 3, lines 23–24).

Up to the present time, the connection for electrical supply of the electrode is conventionally disposed on the frame of the apparatus.

However, the inventors have observed that detrimental electro-magnetic leakages might be produced at the level of the supply connection. It has also been observed that substantial differences in potential might be obtained at the moment of the discharge between the electrodes when the length of the electrical supply conductors was different. It is therefore a main object of the present invention to solve the new technical problem consisting in the limitation or elimination of the electromagnetic leakages due to the electrical supply connection, particularly of the electrodes.

It is a further main object of the present invention to solve the new technical problem consisting in providing an apparatus generating high frequency shock waves capable of obtaining a better uniformity or constancy of the potential and current values generated during the electric discharge or arc between the electrodes, so as to produce reproducible or substantially constant shock waves.

These technical problems are solved for the first time by the present invention.

According to the invention, an apparatus is thus provided for generating high frequency shock waves in a liquid for the remote destruction of targets, preferably constituted by biliary concretions, kidney stones or the like, comprising a device generating shock waves by electric discharge between at least two electrodes disposed at least partly in a chamber filled with said liquid, and advantageously supplied intermittently with electric current from a source of high-voltage electric current, via a supply connection, said generator device allowing the focusing of said shock waves on said targets, characterized in that the electrical supply connection for the electrodes is disposed inside a substantially closed tubular element, in order to limit or prevent electro-magnetic leakages. In addition, the supply connection thus disposed in the tubular element makes it possible to use a substantially constant length of the electrical conductors promoting the generation of a high voltage substantially constant from one apparatus to the other, allowing a better uniformity of the shock waves and therefore of the destruction of the targets.

According to a particular embodiment, wherein the shock wave generator device is mounted to move in any direction in space relatively to the frame of the apparatus, the apparatus according to the invention is characterized in that the said shock wave generator device is connected to said tubular element which is disposed vertically, itself mounted to be mobile in any point in space, the tubular element advantageously being closed at its upper end by the shock wave generator device.

According to an advantageous embodiment, the tubular element is connected to a first plate which is mounted to move in vertical translation, along axis z, on one or more members for guiding in vertical translation, fixed on a second plate forming part of a table moving in the horizontal plane, along axes x-y.

According to a preferred embodiment, wherein the shock wave generator is constituted by an ellipsoidal reflector, the axis of displacement z of the tubular element merges with the axis of revolution of the ellipsoidal reflector.

According to yet another preferred embodiment, the second plate mentioned above is located below the plane of table x, y mentioned above, at a certain distance therefrom, so as to create a housing for the insertion of the shock wave generator device.

According to a further particular embodiment, the tubular element is guided at its upper end inside an annular bearing advantageously provided with seals.

According to another particular feature of the invention, the said electric current supply connection comprises in particular a condenser and an intermediate device for closing the circuit between the electrodes intermittently, preferably of the Spark Gap type. This intermediate device advantageously comprises two electrodes separated by an appropriate distance between which is disposed a spark generating element, for example a spark plug of the type used in automobiles, this device preferably being swept by a stream of gas, advantageously nitrogen.

Said condenser is likewise preferably interposed on the supply conductor of one electrode, whilst the intermediate device is interposed on the supply conductor of the other electrode.

According to a preferred feature of the invention, the shock wave generating apparatus is provided with a device for controlling the advance of the electrodes. This control device may be constituted by the one described in commonly owned U.S. Pat. No. 4,730,614.

In that case, the connection 4, here pneumatic, for controlling the advance of the electrodes is also disposed in the tubular element.

In the event of the shock wave generator apparatus being provided with a device for positioning a scanning probe in space, such as for example described in commonly assigned U.S. patent application Ser. No. 07/117,434 filed Oct. 30, 1987, the supply connection of this scanning device may also be provided to be disposed in the said tubular element.

According to yet another advantageous embodiment, the apparatus according to the invention comprises means for detecting the vertical position of the tubular element and the position in plane x, y of the said table, transmitting data to a receiving center, integrating these values in order to correctly position the shock wave generator device relatively to the target to be destroyed.

It will readily be understood that the invention makes it possible to group together virtually all the electrical and pneumatic supply connections of all the devices, elements or members of the apparatus in one tubular element which then performs analogously the role of a Faraday cage in order to limit or prevent the electromagnetic leakages, which risk giving rise to nuisances. In addition, by this integration, essentially constant lengths of the conductors or like conduits may be used.

This invention will be more readily understood on reading the following description with reference to the accompanying drawings, in which.

Figure 5:
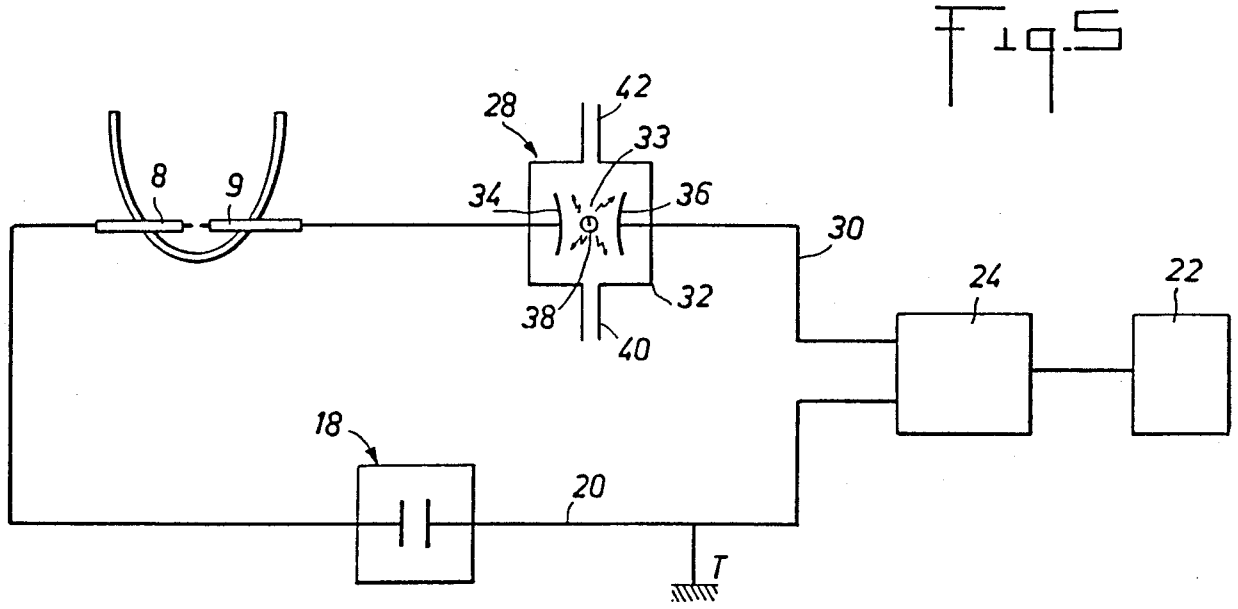

FIG. 5 schematically shows the essential part of the supply connection for supplying the electrodes with electric current.

Referring now to the drawings, and more particularly to FIGS. 1 to 4, an apparatus according to the invention for generating high frequency shock waves in a liquid 2 for the remote destruction of targets, preferably constituted by biliary concretions, kidney stones or the like, comprises a device 4 for generating shock waves by electric discharge between at least two electrodes 6, 8 disposed at least in part in a chamber 10 here shown in ellipsoidal form, filled with liquid 2, and advantageously supplied intermittently from a source of high voltage electric current via a supply connection 12.

For a more precise description of the shock wave generating device of truncated ellipsoidal form, reference may be made to U.S. Pat. No. 2,559,227 to RIEBER or to French Patent No. 2 240 795. Reference may also be made to the aforesaid copending application U.S. Pat. No. 4,730,614. In particular, the electrodes 6, 8 are mounted on an electrode advancing device 14 as described in above said copending U.S. application which is herein incorporated by reference and which is therefore not described in greater detail.

Figure 1:
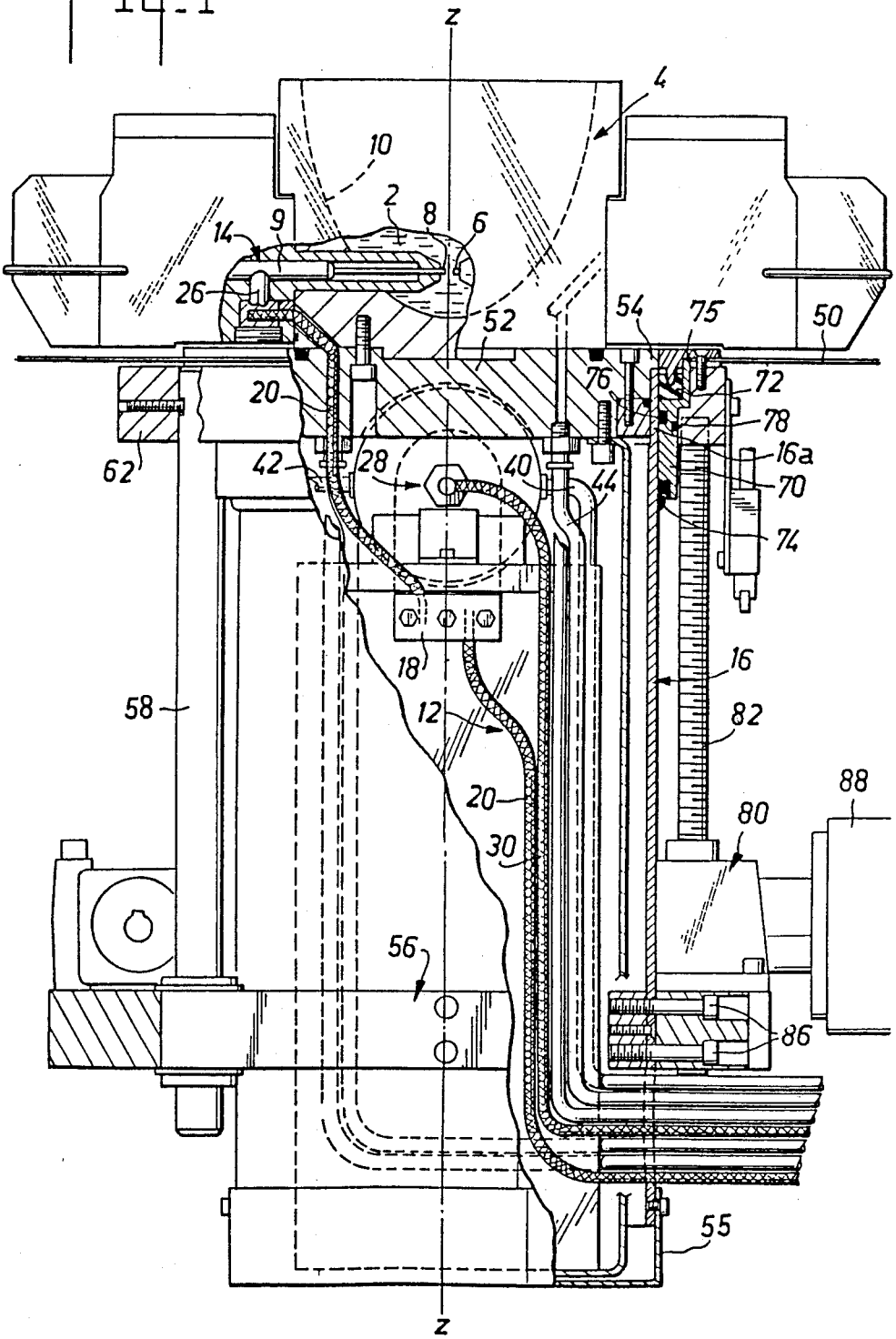
FIG. 1 is a view in partial vertical axis section of an apparatus for generating high frequency shock waves in which the device generating shock waves by electric discharge is constituted by a reflector in truncated ellipsoidal form.

According to the present invention, the electrical supply connection 12 for electrodes 6, 8 is disposed inside a substantially closed tubular element 16 in order to limit or prevent electro-magnetic leakages, as is clearly visible in FIG. 1.

This electrical supply connection 12 for the electrodes 6, 8 comprises in particular a condenser 18 capable of storing a voltage of 10,000 to 20,000 V, interposed for example on the electrical supply conductor 20 of the electrode 8 from the source of electric current 22 symbolized in FIG. 5 combined with a high voltage transformer 24, and terminating in a sliding contact 26 in permanent sliding contact with the electrode-holder element 9.

This supply connection 12 further advantageously comprises an intermediate device 28 for closing the electric circuit between the electrodes 6, 8 intermittently, preferably of the Spark Gap type, interposed in the example shown on the other supply conductor 30 of the other electrode 6.

One of these conductors 20 or 30 is conventionally connected to earth T as symbilized in FIG. 5.

This intermediate device 28 is advantageously constituted by a casing 32 in which are disposed two intermediate electrodes 34, 36 at a distance from each other, this distance being sufficient to interrupt the electric circuit.

This electric circuit is closed by the generation of sparks from a spark generating element 38, for example a spark plug. In order to avoid premature wear of the electrodes 34, 36, it is provided to sweep the chamber 33 defined by the box 32 by a stream of gas, advantageously a stream of nitrogen supplied by suitable conduits 40, 42. As is clearly visible in FIG. 1, the whole of this supply connection is disposed inside the tubular element 16.

Likewise, according to the invention, the connection for controlling the advance of the electrodes 6, 8 is disposed in the tubular element 16 and comprises, essentially in the case of the advancing device forming the subject matter of U.S. Pat. No. 4,730,614, a jack controlled electrically or pneumatically via respective supply conduits such as conduit 44.

According to a preferred embodiment of the apparatus according to the invention, the shock wave generating device 4 is mounted to move in any point in space relatively to frame 50, whilst being connected to the tubular element 16 with the aid of an intermediate support element 52 comprising a flange 54 abutting on the upper end of the tubular element 16 thus obturating it completely and advantageously in a tight manner. The lower end is also closed by a dismountable element 55.

The tubular element 16 is itself mounted to move in any point in space.

According to a particularly advantageous embodiment, the tubular element 16 is thus connected to a first plate 56 which is mounted to move in vertical translation, along axis z, on one or more guiding members 58, 60. These members 58, 60 for guiding in vertical translation are fixed on a second plate 62 forming part of a table 64 moving in the horizontal plane along axes x, y as is clearly understandable from FIG. 2. The second plate 62 is connected to table 64 by rigid connection elements 66, 67, 68, 69.

According to a preferred feature, the second plate 62 is located below the plane of table 64, x, y, at a certain distance d therefrom so as to create a recess for insertion of the shock wave generating device 4, thus making it possible to reduce to a minimum the volume occupied by the apparatus.

Furthermore, the tubular element 16 is advantageously guided at its upper end 16*a* inside an annular bearing 70 advantageously provided with seals 72, 74, 76, 78, respectively on its upper edge, its lower edge and its lateral edges. This annular bearing 70 advantageously comprises a tab 75 for fixation to frame 50 as by a bolt or welding.

The movement of vertical translation of the tubular element 16 supporting the shock wave generating device 4, along axis z, is obtained by a drive system 80, for example of the rack type defined by one or more threaded rods 82, 84 fixed to the second plate 62, constituting an upper plate.

The drive system 80 is fixed to tube 16 by conventional fixing means 86 and comprises a motor member 88 with toothed wheels (not shown) meshing on the threaded rod 82 and a mechanical drive transmission 90, 92 is advantageously provided, with gearing 94, 96 so as also to mesh on the threaded rod 84 opposite the motor member 88.

For simplified assembly, the mechanical transmission comprises single or double universal joint devices 98, 100.

Table x, y 64 is mounted to move in translation along axis x by sliding relatively to two parallel slide tubes 102, 104 themselves mounted to slide in translation along axis y relatively to two parallel tubes disposed along axis y 106, 108 mounted on the frame 50 of the apparatus. The slide tubes 102, 104 are, of course, disposed in respective fixed relationship, being mounted on a rigid support frame 110.

The movement of the table along axes x and y is obtained respectively with the aid of jacks 112, 114 which may be controlled pneumatically or, advantageously, electrically.

Figure 2:
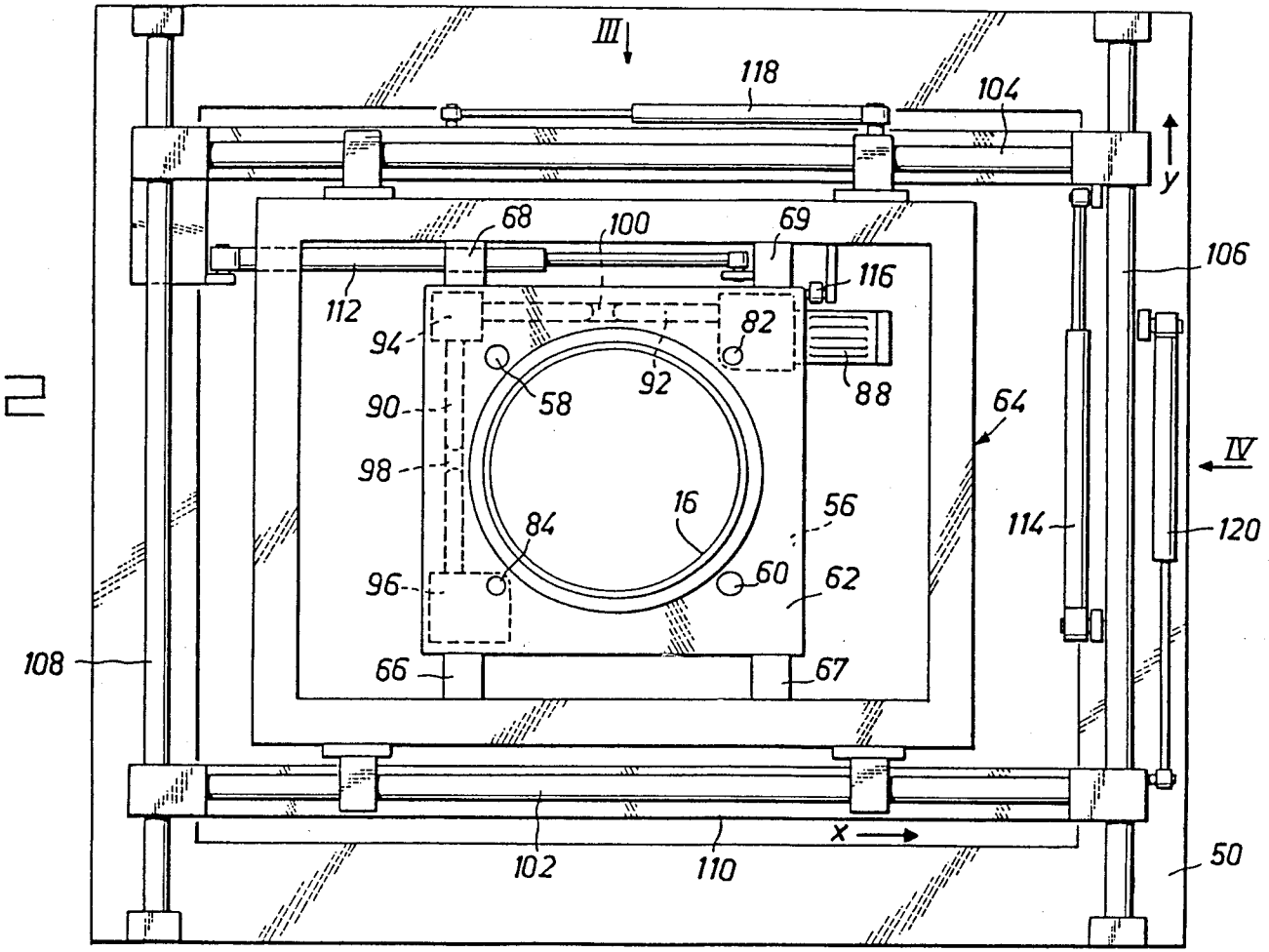
FIG. 2 is a plan view of the control table x, y, with the ellipsoidal generator device removed for better understanding.
Figure 3:
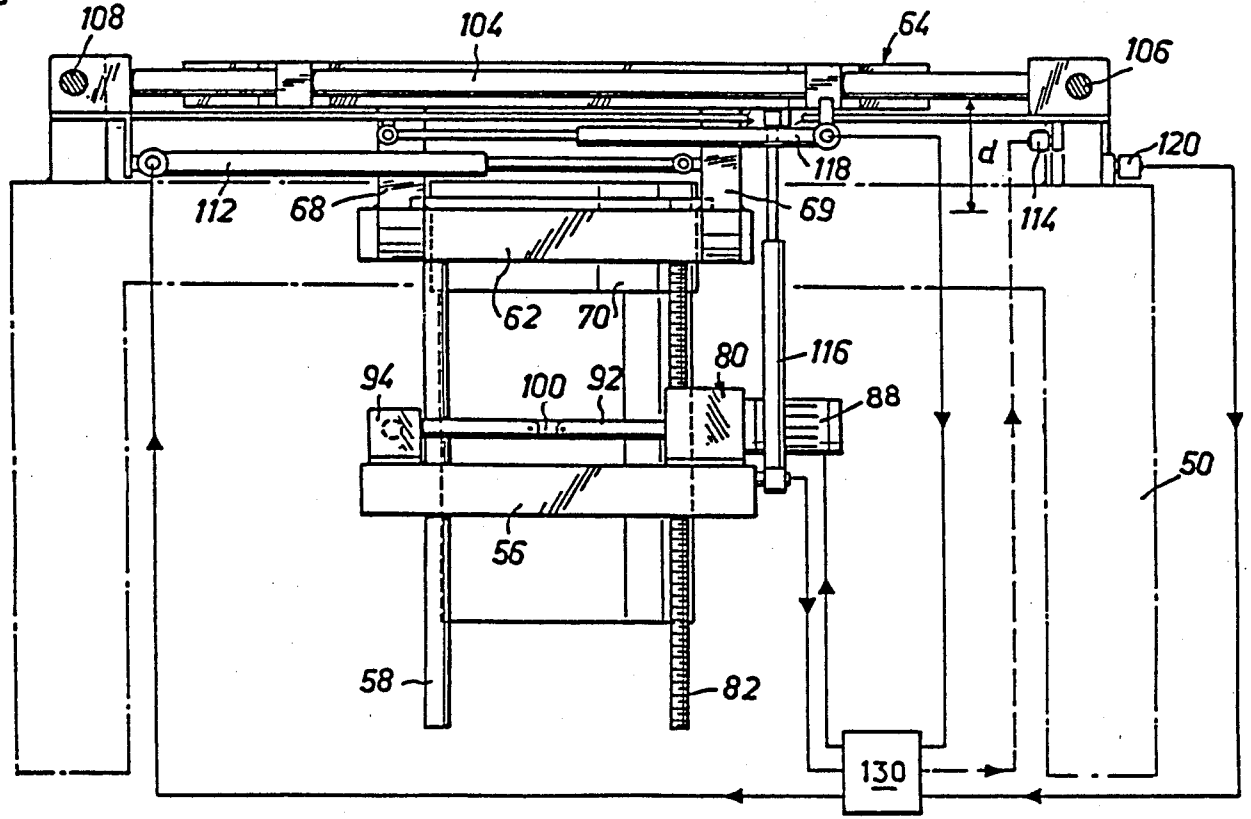
FIG. 3 is a side view in the direction of arrow III of FIG. 2.
Figure 4:
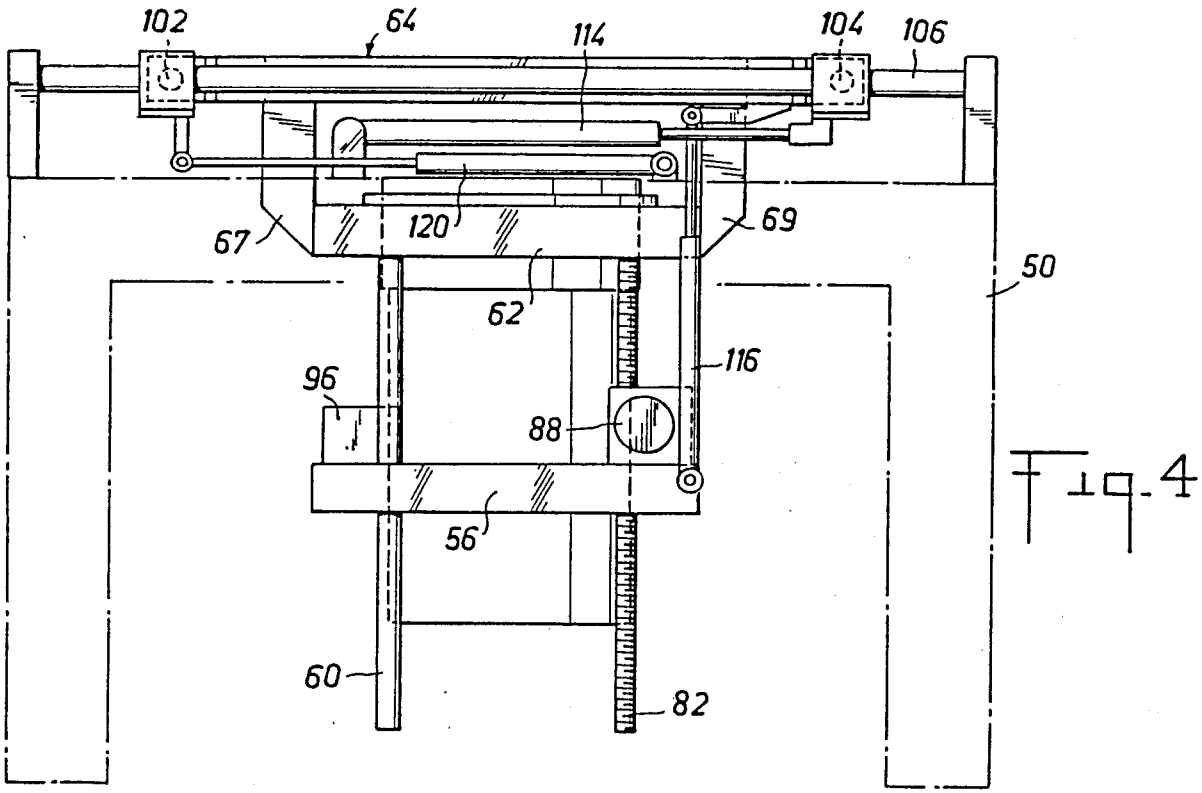
FIG. 4 is a side view in the direction of arrow IV of FIG. 2.

The apparatus according to the invention preferably further comprises means for detecting the vertical position of the tubular element 16, referenced 116 and visible in FIG. 3, and the position in plane x, y of table 64, respectively referenced 118, 120 and which is clearly seen in FIG. 2. For example, these may be devices incorporating potentiometers which transmit data to a receiver center 130 (FIG. 3) integrating these values in order to correctly position the generating device 4 relative to the target to be destroyed by appropriate control of the members for driving in vertical translation such as drive motors 88 and in translation along axes x, y and constituted by jacks 112, 114, respectively.

It will therefore be readily appreciated that, with the integrated structure described hereinabove of the supply connections such as 12 inside the tubular element 16, a reduction or total elimination of the electro-magnetic leakages is obtained, thus radically improving safety of the patients treated with the apparatus. Furthermore, such integration of the electrical and pneumatic supply connections makes it possible to provide essentially constant lengths of the supply conduits, this enabling the different apparatus to be rendered uniform, particularly concerning the electrical resistance of the conductors which is variable as a function of their length.

The nature of the material constituting the tubular element is of course not critical and is appropriate for the purpose sought of reduction or elimination of the electro-magnetic leakages like a Faraday cage. Accordingly, any material usable for making a Faraday cage is appropriate, notably a metal such as iron or a stainless steel.

The present invention therefore brings decisive, unexpected technical advantages over the prior art.

The invention naturally includes all the means constituting technical equivalents of the means described as well as the various combinations thereof.

According to the invention, the expression "supply connection" is understood to mean all the means, elements, members performing a role in the supply of the devices envisaged, such as electrodes, jacks, etc.

What is claimed is:

1. An apparatus for generating high frequency shock waves for the remote destruction of targets, preferably constituted by biliary concretions, kidney stones or the like, comprising a shock wave generator device comprising at least two electrodes disposed at least partly in a chamber filled with a liquid; a source of high-voltage electric current; an electric current supply connection means for intermittently supplying said electrodes with electric current from said source of electric current, said supply connection means comprising at least one condenser and electric conductors connecting said condenser to said electrodes for supplying intermittent electric current to the electrodes; and a substantially closed tubular element, at least a part of said supply connection means, said part including said condenser, being disposed inside said tubular element in order to limit or prevent electromagnetic leakages.

2. The apparatus of claim 1, wherein the shock wave generator comprises an ellipsoidal reflector, the axis z merging with the axis of revolution of the ellipsoidal reflector.

3. The apparatus of claim 1, wherein the supply connection means further comprises an intermediate device comprising closing means for intermittently closing the circuit between the electrodes.

4. The apparatus of claim 1, further comprising an electrode advance controlling device for controlling the advance of the electrodes, and a supply conduit for the controlling device, the supply conduit being disposed in the tubular element.

5. The apparatus of claim 1, wherein the material of the tubular element is a metal.

6. The apparatus of claim 5, wherein the material of the tubular element is selected from a group consisting of iron and a stainless steel.

7. An apparatus for generating high frequency shock waves for the remote destruction of targets, preferably consistuted by biliary concretions, kidney stones or the like, comprising a frame; a shock wave generator device generating shock waves comprising at least two electrodes disposed at least partly in a chamber filled with a liquid; a source of high-voltage electric current; and an electric current supply connection means for intermmittently supplying said electrodes with electric current from said source of electric current, said supply connection means comprising at least one condenser and electric conductors connecting said condenser to said electrodes for intermittently supplying electric current to the electrodes; a substantially closed tubular element, at least a part of said supply connection means being disposed inside said substantially closed tubular element, said tubular element being disposed vertically and being closed at its upper end by the shock wave generator device mounted thereon; moving means for moving said tubular element and correlated shock wave generator device in any point in space relative to said frame; a first plate, the tubular element being connected to said first plate which is mounted to move in vertical translation, along axis z; at least one guiding member for guiding the plate in vertical translation, defining thereby an axis z of translation of the tubular element; a second plate, said guiding member being linked to said second plate which forms part of a table mounted in said frame to move in the horizontal plane, along axes x-y; whereby electromagnetic leakages are limited or prevented while maintaining substantially constant the length, and therefore the electrical resistance, of the electrical conductors between the condenser and the electrodes.

8. The apparatus of claim 7, wherein the second plate is located below the plane of said table at a predetermined distance therefrom, so as to create a housing for the insertion of the shock wave generator device.

9. The apparatus of claim 7, wherein the tubular element is guided at its upper end inside an annular sealed bearing.

10. The apparatus of claim 7, further comprising means for detecting the vertical position of the tubular element and the position in plane x, y of the table, means for transmitting data to means for integrating these values in order to correctly position the shock wave generator device relative to the target to be destroyed.

11. The apparatus of claim 7, wherein the tubular element is made of a metal.

12. An apparatus for generating high frequency shock waves for the remote destruction of targets, preferably constituted by biliary concretions, kidney stones or the like, comprising a shock wave generator device generating shock waves comprising at least two electrodes disposed at least partly in a chamber filled with a liquid; a source of high-voltage electric current; and an electric current supply connection means for intermittently supplying said electrodes with electric current from said source of electric current, said supply connection means comprising at least one condenser and electric conductors connecting said condenser to said electrodes for intermittently supplying electric current to the electrodes; a substantially closed tubular element, at least a part of said supply connection means, comprising said condenser, being disposed inside said tubular element, said tubular element being disposed vertically and being closed at its upper end by the shock wave generator device mounted thereon; and moving means for moving said tubular element and correlated shock wave generator device in any point in space relative to a frame for said apparatus, whereby electromagnetic leakages are limited or prevented, while maintaining substantially constant the length, and therefore the electrical resistance, of the electric conductors between the condenser and the electrodes.

13. The apparatus of claim 12, wherein the tubular element is made of a metal.

14. An apparatus for generating high frequency shock waves for the remote destruction of targets such as biliary concretions, kidney stones or the like, comprising a frame; a shock wave generator device; means for mounting said shock wave generator device to said frame for movement relative thereto; said shock wave generator having at least two electrodes disposed at least partly in a chamber; a source of electric current; an electric current supply connection means for intermittently supplying said electrodes with electric current from said current source, said supply connection means comprising at least one condenser and electric conductors connecting said condenser to said electrodes; a substantially closed tubular element mounted to said shock wave generator for movement therewith, at least a part of said supply connection means, said part including said condenser, being disposed inside said tubular element for reducing electromagnetic leakages.

15. The apparatus of claim 14, wherein the tubular element is a metal.

16. The apparatus of claim 14, further comprising a first plate; means for mounting said first plate for movement relative to said frame in vertical translation, along axis z, said tubular element being connected to said first plate; and a second plate forming part of a table; means for mounting said second plate for movement relative to said frame in a horizontal plane, along axes x and y, said means for mounting said first plate for movement in vertical translation being secured to said second plate for movement therewith.

17. The apparatus of claim 16, wherein the second plate is disposed below the plane of the table at a predetermined distance therefrom, for creating a recess for the shock wave generator device.

18. The apparatus of claim 16, wherein the shock wave generator device comprises an ellipsoidal reflector, said axis z being coincident with the axis of revolution of the ellipsoidal reflector.

19. The apparatus of claim 16, further comprising means for detecting the position of the tubular element along the x, y and z axes; means for transmitting said positions in the form of electrical signals; and means for integrating the signals to correctly position the shock wave generator device relative to a target to be destroyed thereby.

20. The apparatus of claim 14, wherein said at least part of said supply connection means disposed in said tubular element comprises a closing means for intermittently closing the circuit between said electrodes and said source of electric current.

21. The apparatus of claim 14, wherein said tubular element is disposed vertically, and wherein shock wave generator device is mounted on the upper end of said tubular element.

22. The apparatus of claim 14, further comprising means for detecting the position of the tubular element relative to the frame; means for transmitting said position in the form of an electrical signal; and means for integrating the signal to correctly position the shock wave generator device relative to a target to be destroyed thereby.

* * * * *